US005469596A

United States Patent [19]

Rief et al.

[11] Patent Number: 5,469,596

[45] Date of Patent: Nov. 28, 1995

[54] DUAL-USE AND MANUAL POOL CLEANING APPARATUS

[75] Inventors: Dieter J. Rief, Rohnert Park; Herman E. Frentzel, Sausalito, both of Calif.

[73] Assignee: Sta-Rite Industries, Inc., Delavan, Wis.

[21] Appl. No.: 147,822

[22] Filed: Nov. 3, 1993

[51] Int. Cl.[6] ..... E04H 4/16

[52] U.S. Cl. ..... 15/1.7

[58] Field of Search ..... 15/1.7; 210/169

[56] References Cited

U.S. PATENT DOCUMENTS

| | | | |
|---|---|---|---|
| 2,453,376 | 11/1948 | Lagasse . | |
| 3,803,658 | 4/1974 | Raubenheimer | 15/1.7 |
| 3,936,899 | 2/1976 | Henkin . | |
| 3,979,788 | 9/1976 | Strausak . | |
| 4,023,227 | 5/1977 | Chauvier | 15/1.7 |
| 4,063,761 | 12/1977 | Pansini . | |
| 4,133,068 | 1/1979 | Hofmann . | |
| 4,152,802 | 5/1979 | Chauvier . | |
| 4,156,948 | 6/1979 | Chauvier et al. . | |
| 4,275,474 | 6/1981 | Woodard | 15/1.7 |
| 4,351,077 | 9/1982 | Hofman . | |
| 4,409,851 | 10/1983 | Bahrton . | |
| 4,443,899 | 4/1984 | Johnson | 15/1.7 |
| 4,449,265 | 5/1984 | Hoy . | |
| 4,498,206 | 2/1985 | Braukmann | 15/1.7 |
| 4,536,908 | 8/1985 | Raubenheimer . | |
| 4,615,802 | 10/1986 | Harbaugh . | |
| 4,642,833 | 2/1987 | Stoltz et al. . | |
| 4,686,728 | 8/1987 | Rawlins . | |
| 4,692,956 | 9/1987 | Kassis . | |
| 4,722,110 | 2/1988 | Chandler . | |
| 4,761,848 | 8/1988 | Hofmann . | |
| 4,778,599 | 10/1988 | Brooks . | |
| 4,807,318 | 2/1989 | Kallenbach . | |
| 4,817,225 | 4/1989 | Stoltz . | |
| 4,835,809 | 6/1989 | Roumagnac . | |
| 4,849,024 | 7/1989 | Supra . | |
| 4,852,211 | 8/1989 | Strausak . | |
| 4,920,599 | 5/1990 | Rief . | |
| 4,939,806 | 7/1990 | Supra . | |
| 5,001,800 | 3/1991 | Parenti et al. . | |
| 5,014,382 | 5/1991 | Kallenbach . | |
| 5,033,148 | 7/1991 | Chauvier et al. . | |
| 5,044,034 | 9/1991 | Iannucci | 15/1.7 |
| 5,048,149 | 9/1991 | Heinen, Jr. . | |
| 5,093,950 | 3/1992 | Heier . | |
| 5,097,559 | 3/1992 | Brunt et al. . | |
| 5,099,535 | 3/1992 | Chauvier et al. | 15/1.7 |
| 5,293,659 | 3/1994 | Rief et al. | 15/1.7 |
| 5,303,444 | 4/1994 | Sebor | 15/1.7 |

FOREIGN PATENT DOCUMENTS

| | | |
|---|---|---|
| 1202755 | 6/1983 | Canada . |
| 648893 | 12/1978 | Switzerland . |

*Primary Examiner*—Edward L. Roberts, Jr.
*Attorney, Agent, or Firm*—Jansson & Shupe, Ltd.

[57] ABSTRACT

An automatic swimming pool cleaner of the type driven by water flow, having a housing forming a chamber open at its lower side, pivotable attachment of a hose, and a handle pivotably and detachably secured to the housing, such that the pool cleaner can be used manually or automatically as desired. Various embodiments of the invention include vibratory bristle drive to provide forward motion, directional change, rotational scrubbing, and/or vibratory scrubbing action for dual-use (automatic or manual) and manual cleaning apparatus.

19 Claims, 8 Drawing Sheets

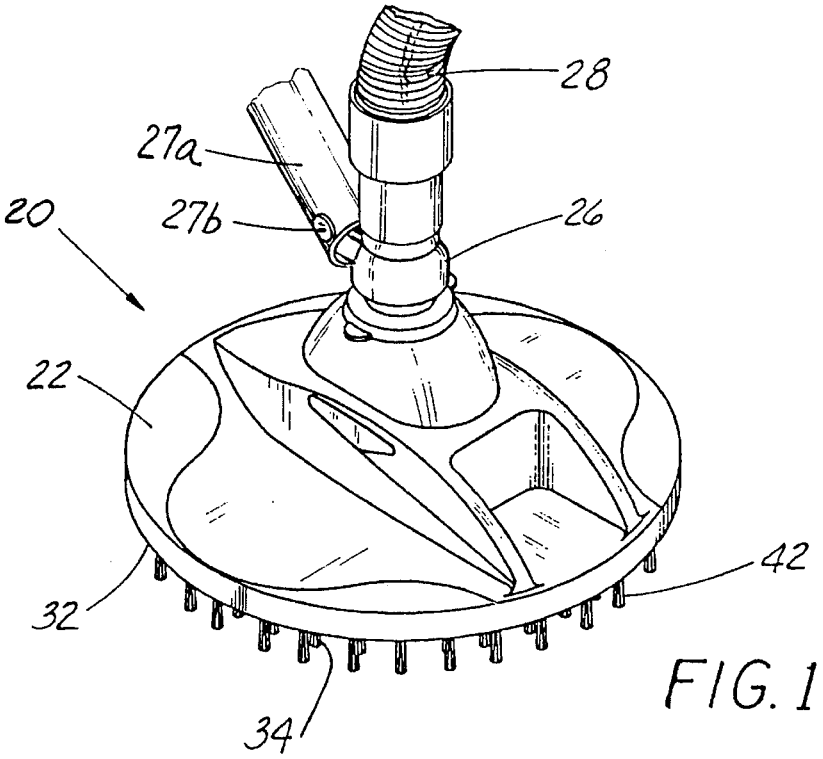
FIG. 1
FIG. 2
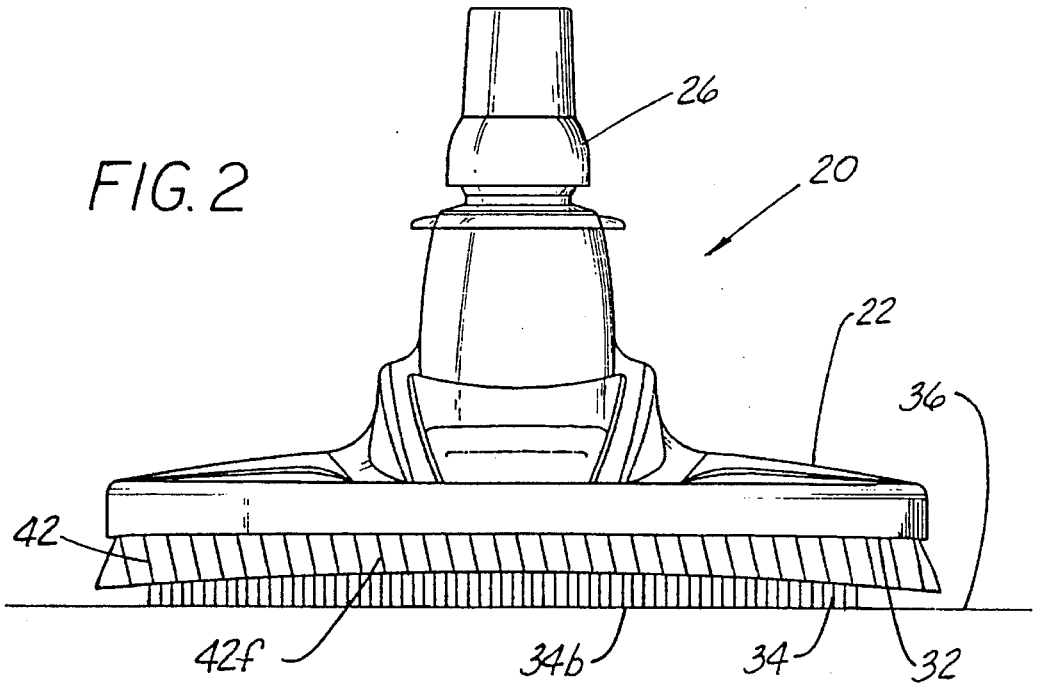

DUAL-USE AND MANUAL POOL CLEANING APPARATUS

FIELD OF THE INVENTION

This invention is related generally to swimming pool cleaners and, more particularly, to swimming pool cleaners capable of operation without human assistance.

BACKGROUND OF THE INVENTION

Automatic swimming pool cleaners are widely used to relieve swimming pool owners of the time-consuming and arduous task of hand-operated vacuuming of underwater pool surfaces. Such manual task, which typically involved the use of long extension handles and clumsy manipulation of a water-suction head held under water and at a distance, have largely been made a thing of the past by automatic systems. In recent decades, many automatic swimming pool cleaners of various types have been available and in wide use around the world.

A typical automatic swimming pool cleaner has a suction head including a housing, a chamber open at its lower side, and a pivotable connector to which a long flexible hose is attached to allow movement of the swimming pool cleaner in the pool. The hose typically extends toward a remote pump which causes water flow from along the pool bottom surface, through the chamber and into the hose, removing dirt and debris from the bottom surface of the pool. The flow of water caused by the pump is harnessed in various ways to cause movement of the swimming pool cleaner.

While automatic swimming pool cleaners are highly beneficial, there are times, regardless of which cleaner may be in use for automatic cleaning, when it may be considered desirable for various reasons to engage in some manual cleaning, particularly of limited areas of underwater pool surfaces. It may be desirable, for example, to engage in manual cleaning in order to overcome a specific problem, such as a particularly bad deposit of algae, or to clean an area where dirt or debris has just been deposited. It some cases it may be considered desirable to complete an underwater surface area without waiting for the automatic pool cleaner to reach such area.

In some cases, it may be desirable to clean certain underwater surfaces which are not reachable by the automatic pool cleaner. An example of such unreachable surfaces would be the underwater surfaces of a hot tub or spa which is adjacent to the swimming pool, as is often the case. Another example may be the surfaces of underwater steps in the swimming pool itself.

Because of the nature of various automatic pool cleaners, adapting such cleaners for use in manual cleaning would be problematic at best. Certain pool cleaners have wheels, tracks and/or various other drive mechanisms which engage the pool bottom surface, making it unreasonable and impractical to adapt them for manual use. Certain other pool cleaners, because they are rather tightly held against the pool bottom surface during operation, could not be effectively manipulated even if otherwise adapted for manual use. Various automatic pool cleaners are also unreasonably bulky and heavy to even consider adaptation for manual use.

Furthermore, typical manual pool cleaning suction heads are devoid of powered scrubbing devices. Such devices typically depend on the suction flow of water and/or mechanical force provided by manipulation of such devices by the user—through the handle. Thus, manual pool cleaning devices are often less effective than might be desired and can require considerable operator exertion.

There has been a clear need for improved swimming pool cleaning apparatus, and it is such need to which the invention described herein is addressed.

OBJECTS OF THE INVENTION

It is an object of this invention to provide a swimming pool cleaner which overcomes some of the problems and shortcomings of devices of the prior art.

Another object of this invention is to provide a dual-use swimming pool cleaner, that is, a swimming pool cleaner usable in both automatic cleaning and manual cleaning.

Another object of this invention is to provide a dual-use swimming pool cleaner which reliably and effectively cleans the underwater surfaces of a swimming pool.

Another object of this invention is to provide improved manual swimming pool cleaning apparatus.

Another object of this invention is to provide manual swimming pool cleaning apparatus having improved cleaning effectiveness.

Another object of this invention is to provide a manual swimming pool cleaning apparatus requiring less operator exertion than with certain other manual pool cleaning apparatus.

Another object of this invention is to provide an improved automatic swimming pool cleaner which is also usable manually to clean usually unreachable surfaces such as the underwater surfaces of hot tubs and spas adjacent to the swimming pool in which the automatic pool cleaner operates.

Still another object of this invention is to provide dual-use swimming pool cleaning apparatus which is free of turbines, gears, wheels and other similar moving mechanical devices.

Another object of this invention is to provide dual-use swimming pool cleaning apparatus which is simple in construction and highly reliable in operation.

These and other important objects will be apparent from the descriptions and drawings herein.

SUMMARY OF THE INVENTION

This invention is an improvement in swimming pool cleaning apparatus of the type powered by water flow therethrough. More specifically, this invention, in one form, is a dual-use swimming pool cleaner—that is, an automatic pool cleaner which is also effectively and easily usable for manual pool cleaning, as selected by the operator. In another form, this invention is an improvement in manual pool cleaning apparatus, providing powered scrubbing of underwater pool surfaces.

The apparatus of this invention includes a housing forming a chamber open at its lower side, a hose connection device on the housing, a handle attachment device on the housing, and a handle detachably secured to the handle attachment device. The pool cleaning apparatus of this invention can be used in an automatic mode without attachment of the handle, or the apparatus can be withdrawn from autocratic operation and used for manual cleaning of various underwater surfaces, including those of an adjacent hot tub or spa, such use being facilitated by attachment of the handle. And, the apparatus of this invention is a manual cleaner with powered scrubbing.

A highly preferred dual-use pool cleaner of this invention includes: a vibrator device secured to the housing to vibrate the head in response to water flow through the chamber; main bristles secured with respect to the housing and projecting downwardly to terminate in main-bristle ends for supporting the pool cleaner on a surface to be cleaned, such main bristles inclined in a first direction such that vibration causes forward movement; and secondary bristles in fixed position with respect to the housing and projecting downwardly to terminate in secondary-bristle ends positioned for engagement with the surface to be cleaned, such secondary bristles inclined in a second direction such that, upon contact thereof with the surface to be cleaned, vibration causes a turning away from the forward direction.

This sort of automatic pool cleaner drive system makes an effective and efficient dual-use pool cleaner possible. Such pool cleaner is light in weight and has no drive wheels, treads or other devices. Each of these favorable characteristics facilitates adaptation for manual cleaning when desired.

In certain of such preferred embodiments, the secondary-bristle ends are positioned with respect to the common plane to at least periodically engage off-planar portions of the surface to be cleaned. In automatic-mode usage, this allows turning to at least intermittently occur.

In highly preferred embodiments, the housing has a lower edge surrounding the chamber and the secondary flexible bristles are affixed along the lower edge. In certain preferred dual-use pool cleaners in accordance with this invention, the secondary bristles project both outwardly and downwardly and are disposed at a rotational angle such that their engagement with pool side surfaces causes a turning deflection in pool cleaner movement. In such embodiments, it is highly preferred that the main bristles be secured along the lower edge of the housing, with the secondary bristles positioned outside the main bristles. The main bristles are preferably secured to a main-bristle ring which is removably secured to the housing. Likewise, the secondary bristles are preferably secured to a secondary-bristle ring which is removably secured to the housing.

In certain preferred embodiments, the hose and the handle are pivotably connected to the housing. Most preferably, the hose connection device is a spherical joint and the handle is attached to the spherical joint.

This invention, in another form, is manual pool cleaning apparatus of the type having a housing forming a chamber open at its lower side, a hose connection device on the housing allowing water to be drawn through the chamber, and a handle secured to the housing to allow an operator to move the apparatus along underwater surfaces to be cleaned. The invention includes a vibrator secured to the housing to vibrate the housing and flexible bristles secured with respect to the housing at off-center positions, such bristles projecting downwardly to terminate in bristle ends for supporting the pool cleaner on a surface to be cleaned. The vibration of the housing and bristles enhances cleaning action of the brush. In a particularly preferred form, the bristles are inclined such that, when their ends engage a horizontal surface, they deviate from vertical in a substantially common rotational direction. This allows vibration to cause rotation of the apparatus, thereby giving an extra scrubbing action in a manual pool cleaner.

In such pool cleaning apparatus, the vibrator is preferably a device which vibrates in response to water flow through the chamber. The housing preferably has a lower edge surrounding the chamber and the bristles are affixed along the lower edge. Most preferably, the bristles are secured to a bristle ring which is removably secured to the housing. Preferably, the hose and the handle are pivotably connected to the housing. Most preferably, the hose connection device is a spherical joint and the handle is attached to the spherical joint; this facilitates the aforementioned rotational motion.

As manual or dual-use pool cleaners, the devices of this invention provide capabilities and performance unlike anything known to date.

BRIEF DESCRIPTION OF THE DRAWINGS

FIG. 1 is a perspective of a preferred dual-use automatic swimming pool cleaner in accordance with this invention.

FIG. 2 is a front elevation of the device of FIG. 1.

Figure 4:
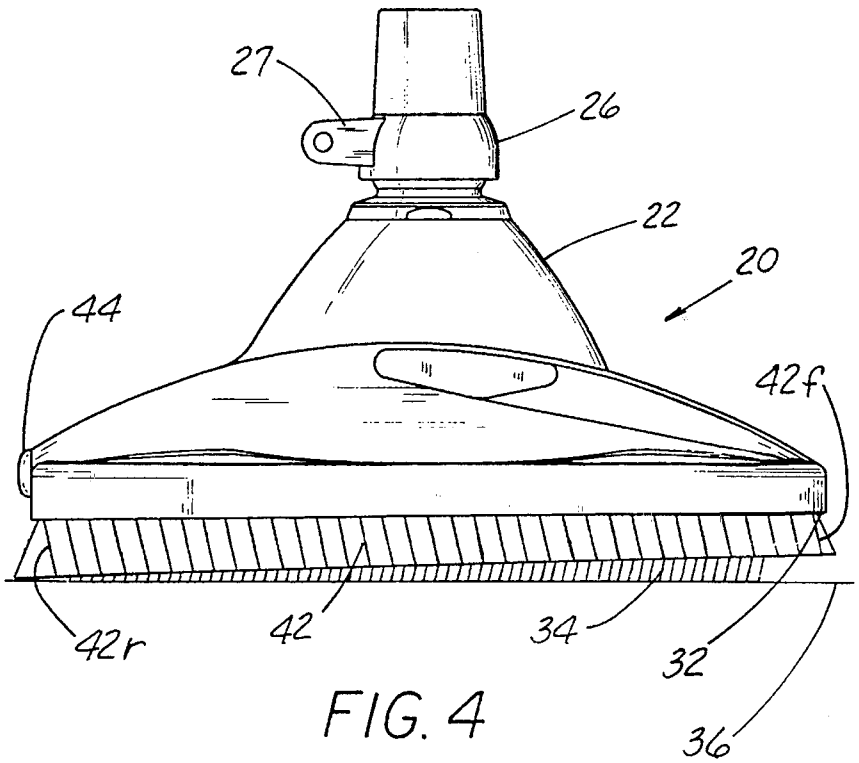
FIG. 4 is a side elevation.

As will be noted, for reasons of convenience several of the figures represent bristles somewhat schematically, rather than in actual form. The required characteristics of such bristles, however, is disclosed by such figures and by the written descriptions herein.

DETAILED DESCRIPTION OF PREFERRED EMBODIMENTS

FIGS. 1–16 illustrate a dual-use automatic swimming pool cleaner suction head 20 in accordance with this invention. Suction head 20 has a housing 22, a chamber 24 (see FIGS. 6, 8 and 9) which is open at the lower side of housing 22, and a pivotable hose connection 26, more specifically, a spherical joint, on housing 22 allowing pivotable connection of a hose 28 through which a remote suction pump (not shown) causes water flow through chamber 24 and into hose 28, removing dirt and debris from the underwater surface of the pool.

Lugs 27 at hose connection (spherical joint) 26 are used to removably attach an elongate handle (pole) **27*a* to housing 22. Handle 27*a* is removed during automatic pool cleaning operations and attached for manual operations. Handle 27***a* is attached by means of a removable pin 27*b*.

As shown best in FIGS. 5, 6, 8 and 9, chamber 24 includes a central outflow portion 24*a* and a surrounding inflow portion 24*b* which extends to the periphery of housing 22. As shown in FIGS. 6–9 and 13, suction head 20 includes a vibrator 30 in outflow portion 24*a* of chamber 24. Vibrator 30 is pivotably secured to housing 22 by means of a shaft 30*a*, and is designed to freely oscillate within outflow chamber portion 24*a* in response to water flow through chamber portion 24*a*. As shown best in FIGS. 7 and 8, shaft 30*a* is journaled in holes 30*b* in housing 22 and is held in place by retainer plates 30*c* which are engaged with housing 22.

Figure 7:
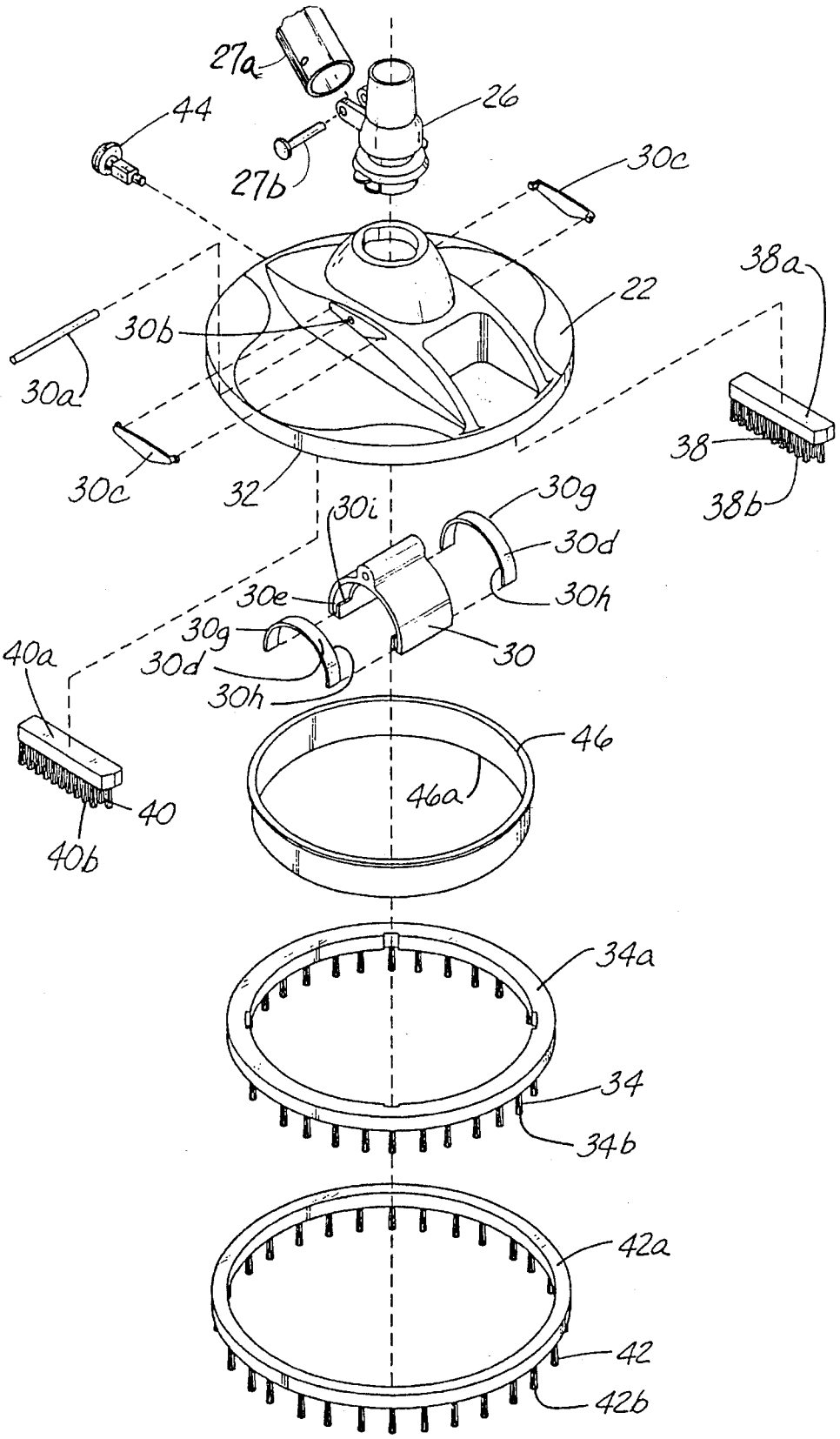
FIG. 7 is an exploded view.
Figure 9:
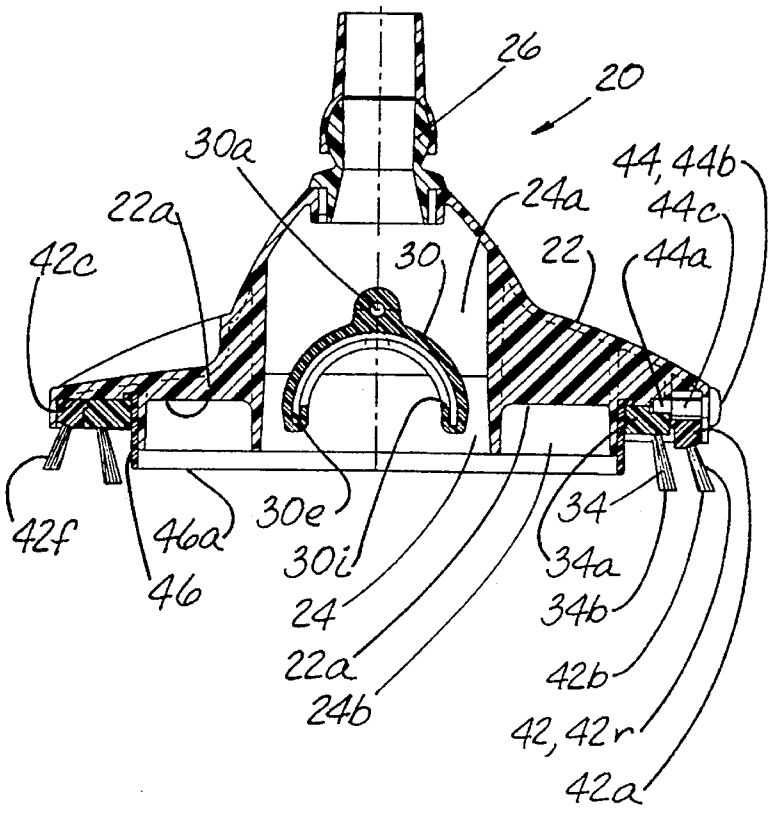
FIG. 9 is a sectional view taken along section 9—9 as indicated in FIG. 5.
Figure 13:
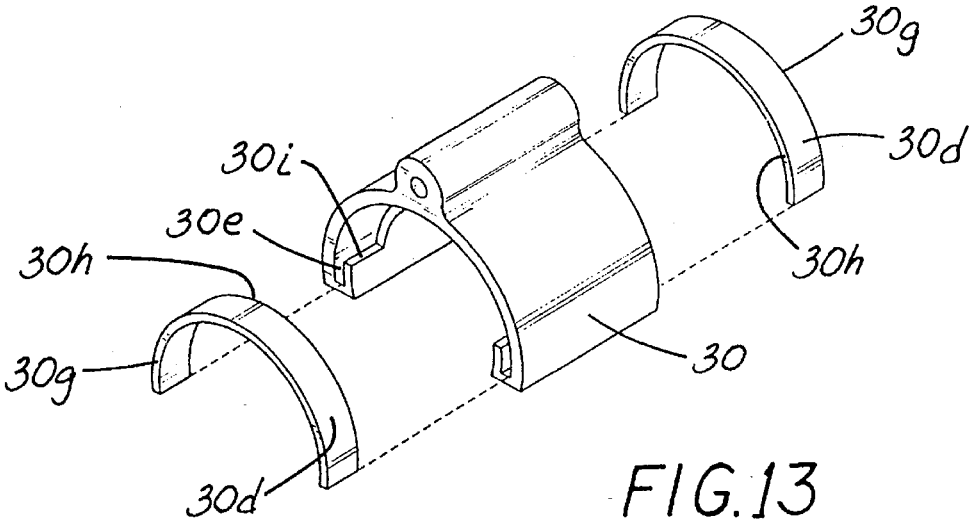
FIG. 13 is an enlarged exploded perspective view of the vibrator device used in the dual-use automatic swimming pool cleaner.
Figure 14:
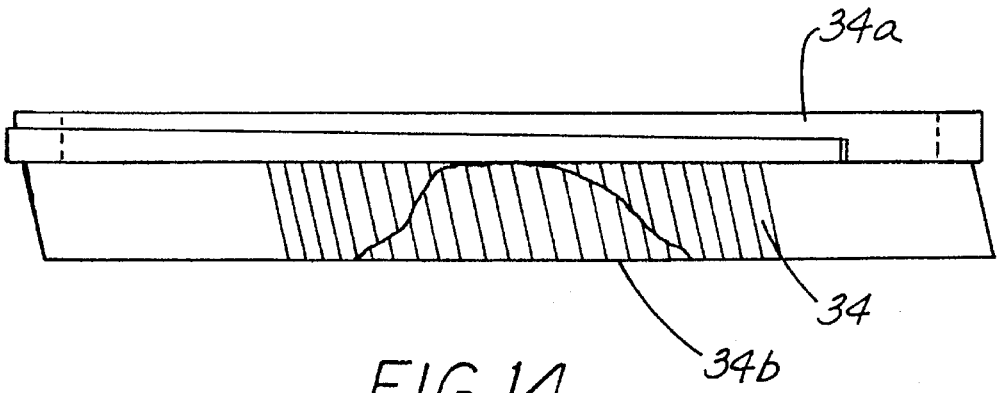
FIG. 14 is a partially cutaway side elevation of the main-bristle ring.

As shown in FIGS. 7, 9 and 13, vibrator 30 has a crescent-like or airfoil-like cross-section and is located in dome-like outflow chamber portion 24, with the convex side of vibrator 30 oriented toward hose connection 26. The profile and dimensions of vibrator 30 have been developed to provide a self-starting and relatively constant speed vibration which is powered by the flow of water up toward outlet hose 28. Flow of water causes an oscillation of vibrator 30, and the oscillatory momentum and impact forces (including movements of water mass) are imparted to housing 22 to cause vibratory motion.

As shown in FIGS. 6–8 and 13, a pair of arc-like sliding seals 30*d* are carried in lateral slots 30*e* on either opposite edge of vibrator 30 in position to engage opposed inner side walls 30*f* of chamber portion 24. Sliding seals 30*d* serve to seal vibrator 30 to side walls 30*f* and prevent excessive by-pass of water and yet allow sand or other small particles to escape to avoid clogging and lock-up and to avoid damage to parts. Sliding seals 30*d* can move inwardly as necessary to accommodate the passing of sand or other particles.

Sliding seals 30*d* are forced toward side walls 30*f* by the difference in hydraulic pressure between opposite edges of each of the sliding seals. Lower pressure fluid is exposed to seal outer edges 30*g* than is exposed to seal inner edges 30*h* (see FIGS. 6, 7, 8 and 13), and the higher pressure along seal inner edges 30*h* pushes seals 30*d* outwardly toward the lower pressure or suction sides of seal 30*d* (that is, in the direction toward seal outer edges 30*g*), causing engagement with side walls 30*f*.

As shown in FIGS. 6–9 and 13, best in FIG. 13, the lateral slot-forming portions of vibrator 30 have deep notches 30*i* which facilitate effective operation of the pressure differential in allowing pressure-driven outward movement of sliding seals 30*d*. Notches 30*i* also serve to fully expose much of the surfaces of seals 30*d*, allowing seals 30*d* to remain free to move within lateral slots 30*e*—by reducing or eliminating spaces where sand or dirt particles could accumulate to interfere with operation.

As already noted, vibrator 30 causes vibration of housing 22 as water passes through suction head 20. And, vibration acts through inclined bristles or other like flexures to cause forward movement of suction head 20. Housing has a lower edge 32 which surrounds chamber 24, and secured along lower edge 32 are main bristles 34 such bristles forming something of an annulus of main bristles 34. More specifically, main bristles 34 are secured to a main-bristle ring 34*a* and such ring is removably secured to housing 22 along lower edge 32.

Figure 3:
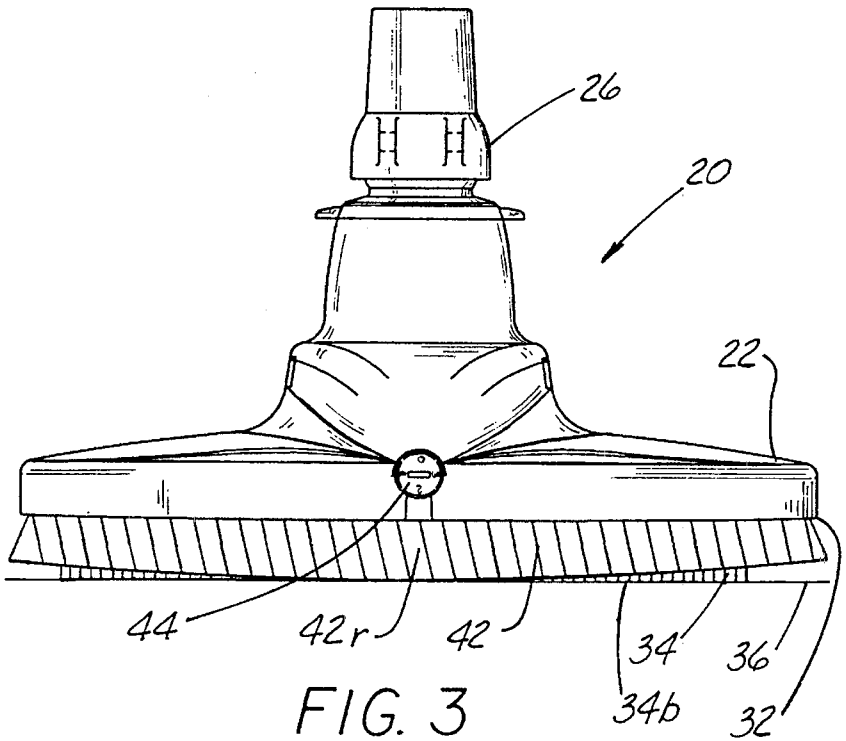
FIG. 3 is a rear elevation.

Main bristles 34 project downwardly to terminate in free main-bristle ends 34b which are disposed in a common plane and support suction head 20 on an underwater swimming pool surface to be cleaned. FIGS. 2–4 include a reference line 36 which is representative of a planar horizontal pool bottom surface, that is, a surface to be cleaned; as shown in FIGS. 2–4, such line is also representative of the common plane in which main-bristle ends 34*b* are disposed, given that in such views suction head 20 is supported by surface 36. The orientation of bristles will be described herein by reference to a vertical direction with respect to a horizontal surface such as that represented by reference line 35.

Main bristles 34 are affixed to main-bristle ring 34*a* at an angle; they deviate from vertical in a common direction at all locations about ring 34*a*. Such inclination, or deviation from vertical, is preferably about 8° to 18°, more preferably about 10° to 14°, with about 12° most preferred. This inclination of main bristles 34 about main-bristle ring 34*a* is illustrated best in FIG. 14, the breakaway portion of which shows that bristles on the far side of main-bristle ring 34*a* are angled in the same direction as those on the near side. Vibration of housing 22, acting through the combined rapid small motions of the many main bristles 34 about ring 34*b*, causes forward motion of suction head 20.

Suction head 20 has three groups of secondary bristles. These include two inside secondary-bristle groups 38 and 40 and an outer annulus of side secondary bristles 42 on secondary-bristle ring 42*a*. All of such secondary bristles, during operation of suction head 20, are in fixed vertical positions, although adjustment is possible with respect to bristles 42 of secondary-bristle ring 42*a*. All of such secondary bristles are inclined, that is, deviate with respect to the vertical direction. Such angle of inclination is preferably about 8° to 18°, more preferably about 10° to 14°, with about 12° most preferred, but such bristles are mounted so that most are inclined in a direction or directions different than the direction of inclination of main bristles 34.

As earlier described, contact of secondary-bristle ends with the surface to be cleaned as suction head 20 moves therealong such surface causes turning in the direction of movement of suction head 20. That is, the vibration causes a turning of the head away from the forward direction by virtue of the vibratory action of the secondary bristles—as with the main bristles, but in a different, and therefore turning, direction. The extent of turning depends on the extent of secondary bristle end contact with the surface to be cleaned.

Secondary-bristle groups 38 and 40 are secured to the downwardly-facing middle surface 22*a* of housing 22, a surface surrounded by housing lower edge 32. See FIGS. 6–9 and 16. Secondary bristle groups 38 and 40 are secured to bristle blocks 38*a* and 40*a*, respectively, which are secured with respect to housing 22 such that the bristles of bristle groups 38 and 40 are in fixed vertical positions, with their bristle ends 38*b* and 40*b* at or about at the aforementioned common plane which is defined by main-bristle ends 34*b*.

Figure 6:
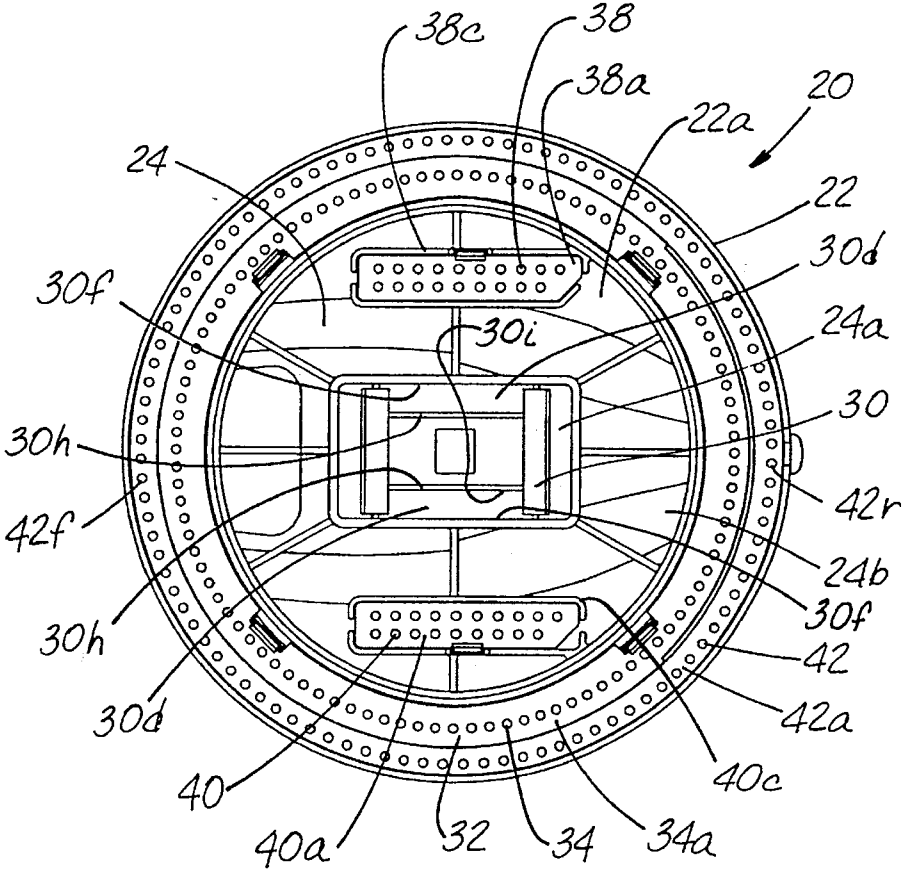
FIG. 6 is a bottom plan view.
Figure 5:
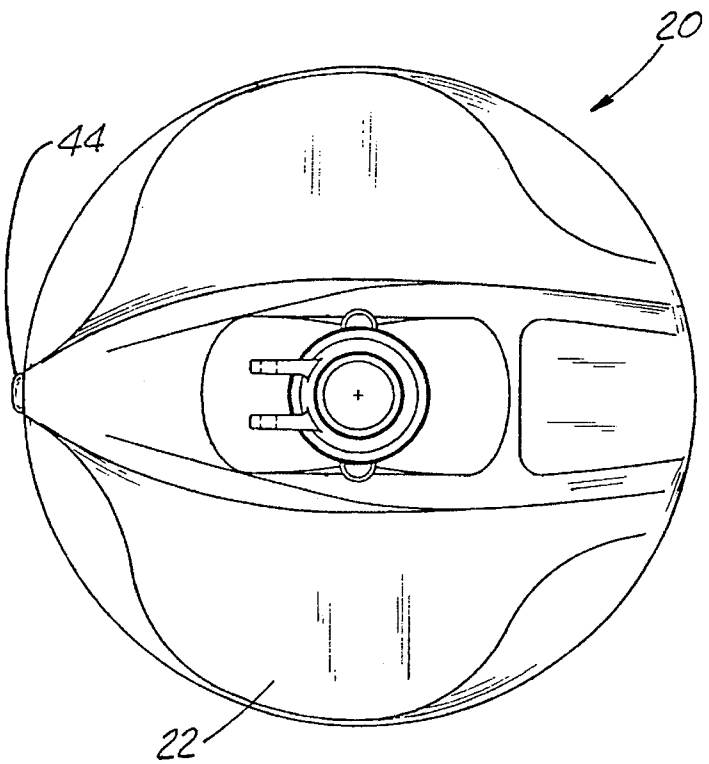
FIG. 5 is a top plan view.

As shown best in FIG. 6, bristle blocks 38*a* and 40*a* are attached within securement walls 38*c* and 40*c*, respectively, which are formed on (and are part of) downwardly-facing middle surface 22a of housing 22. Securement wall 38*c* is shaped with a tapered corner such that one of the bristle blocks, in this case bristle block 38*a*, can be secured therein in only one orientation—that is, with its secondary bristles 38 inclined in a direction different than the direction of inclination of main-bristles 34. Bristle block 38*a* cannot be reversed in its orientation. On the other hand, securement wall 40*c* is generally rectangular in shape without any irregular features which would limit the manner in which bristle block 40*a* is inserted therein.

Thus, bristle block 40*a* may be removed, reversed in orientation, reinserted and reattached within securement wall 40*c*, allowing its secondary bristles to be in either of at least two different, orientations. The illustrated arrangement has secondary bristle groups 38 and 40 inclined in opposite directions—that is, in a common direction when considered rotationally—and this serves to impart an enhanced rotational motion to suction head 20, thus facilitating turning of suction head 22 from its direction of forward movement.

It has been found that the irregularities in the otherwise flat underwater surfaces of swimming pools—that is, portions which are off-flat or off-smooth surfaces—interact with secondary bristles as suction head 20 moves about a swimming pool under the vibratory action of main-bristles 34. More turning is achieved if the ends of the secondary bristles protrude more from the bottom of housing 22; less turning is achieved if the secondary-bristle ends are recessed a bit. It has been found that locating secondary bristle groups 38 and 40 such that bristle ends 38*b* and 40*b* are at or very near the aforementioned common plane provides ample random turning action. This turning action can be either enhanced or controlled by reversal of the orientation of bristle group 40.

Figure 8:
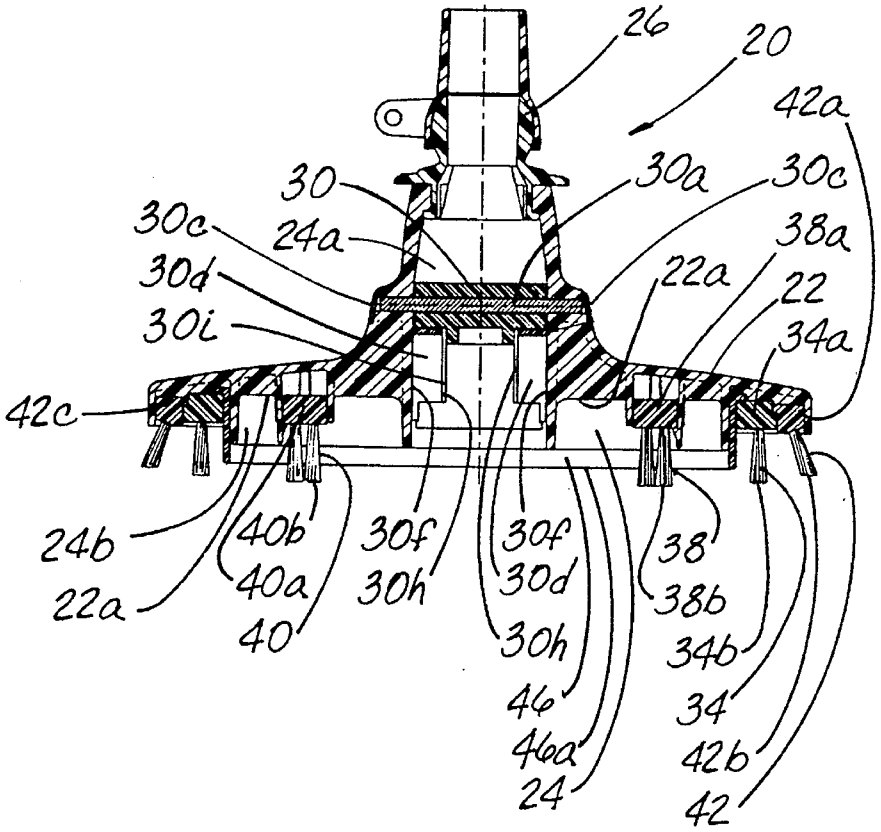
FIG. 8 is a sectional view taken along section 8—8 as indicated in FIG. 5.
Figure 12:
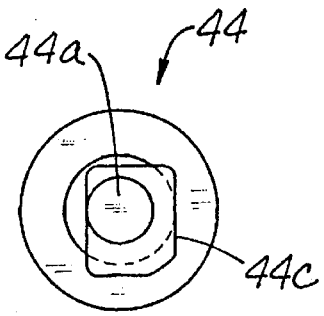
FIG. 12 is a left side elevation of FIG. 10, showing the other end of the height adjustment device.
Figure 10:
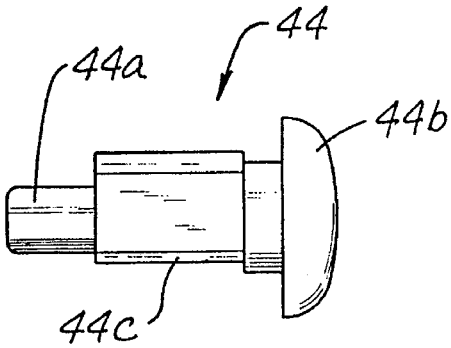
FIG. 10 is a side view of an adjustment device which is used for adjusting the vertical position of a portion of the secondary-bristle ring.
Figure 11:
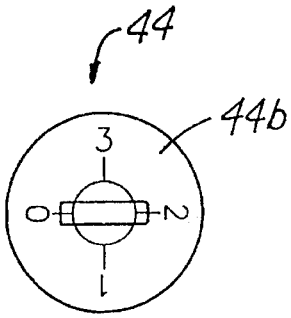
FIG. 11 is a right side elevation of FIG. 10, showing the head of the adjustment device.

As shown in FIGS. 2–4 and 6–9, best in FIGS. 8 and 9, ring 42*a* to which secondary bristles 42 (that is, "side" secondary bristles) are secured, is secured to housing lower edge 32 in a position which is concentric with main-bristle ring 34*a* at a position outside (that is, radially outside) main-bristle ring 34*a*. Both rings 34*a* and 42*a* are removably secured along lower edge 32, and may therefore be replaced when worn.

Figure 15:
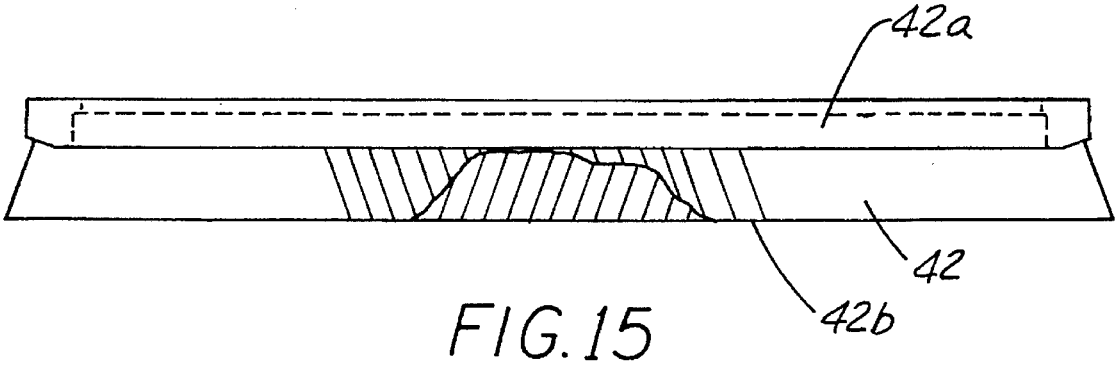
FIG. 15 is a partially cutaway side elevation of the secondary-bristle ring.
Figure 16:
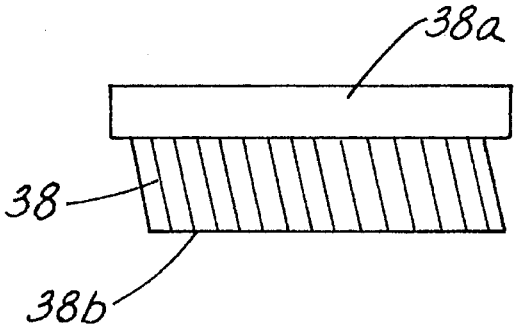
FIG. 16 is a partially cutaway side elevation of a secondary-bristle group.

Side secondary bristles 42 project both outwardly and downwardly and terminate short of the common plane indicated by reference line 36 (in FIGS. 2–4). As shown in FIG. 15, which includes a breakaway portion allowing illustration of bristle orientations on both the near side and the far sidle of secondary-bristle ring 42*a*, secondary bristles 42 are disposed at a common rotational angle—about 12° to vertical—such that engagement of bristle ends 42*b* with pool bottom surfaces causes a turning deflection of suction head 20. And, in addition to such rotational angle, bristles 42 are oriented to project radially outwardly, preferably about 16° to 24° from vertical, most preferably about 20°. This facilitates engagement with pool side walls as they are approached by suction head 20, and the combination of rotational and radial angling causes turning of suction head 20 when such bristles hit a side wall.

As shown in FIGS. 2–4, 6 and 9, secondary-bristle ring 42*a* is in a tilted orientation such that the ends of its rear bristles 42*r*, that is, its bristles generally along the rear circumferential portion of ring 42*a*, are at a lower position than are the ends of its front bristles 42*f*, that is, its bristles generally along the front circumferential portion of ring 42. The ends of the bristles of secondary-bristle ring 42 at circumferential portions between the front and the rear are at levels therebetween. The rear circumferential portion of secondary-bristle ring 42*a* is referred to herein as a low circumferential portion. Its level is because of the tilt of ring 42; all bristles 42 are of substantially equal lengths.

Not only is ring 42*a* tilted, but the extent of tilt of ring 42*a* is adjustable. As shown in FIGS. 8 and 9, the upper surface of ring 42*a* is against ring-placement surface 42*c* which is part of the under surface of housing 22 along housing lower edge 32. Ring-placement surface 42*c*, while planar, is tilted with respect to a horizontal plane such that ring 42*a* is tilted.

As illustrated best in FIG. 9, between the rear circumferential portion of ring 42*a* and the adjacent portion of ring-placement surface 42*c* is a tilt-adjuster 44. Tilt-adjuster 44, shown in detail in FIGS. 10–12, has an inner end which is rotatably secured to housing 22, an outer end 44*b* by which the rotational orientation of tilt-adjuster 44 is set (for example, by using a screw driver), and a middle camming portion 44*c*. As shown best in FIG. 12, camming portion 44*c* has four sides, each of such sides having a different spacing from the axis of tilt-adjuster 44.

In the embodiment illustrated, tilt-adjuster 44 adjusts the tilt of secondary-bristle ring 42*a* between an orientation in which the ends of rear bristles 42*r* are at about the level of common plane 36 (and, thus, at about the level of main-bristle ends 34*b*) and an orientation in which the ends of rear bristles 42*r* are about three millimeters above common plane 36. Adjustments can be made to intermediate positions in which the ends of rear bristles 42*r* are either one or two millimeters above common plane 36. Outer end 44*b* of tilt-adjuster 44 is marked as a guide for such adjustment. When in its highest position of adjustment, the ends of front bristles 42*f* are still at a level about three millimeters above the level of the ends of rear bristles 42*r*.

This adjustability in the vertical positions of secondary-bristle ends 42*b* provides a further way to assure that the turning action provided by the secondary bristles of suction head 20 is appropriate for effective cleaning of a particular swimming pool.

As illustrated in FIGS. 6–9, a skirt 46, which is concentric with bristle rings 34*a* and 42*a*, projects downwardly from housing 22 at a position radially inside main-bristle ring 34. Bristle rings 34*a* and 42*a* and skirt 46 are configured and dimensioned for engagement with one another to facilitate assembly of suction head 20. Skirt 46 extends downwardly to a skirt lower edge 46*a* which is spaced well above the ends of both main bristles 34 and secondary bristles 42, that is, above the ends of the bristles of both bristle rings. Such spacing determines the gap through which water and debris will pass in entering housing chamber 24, and the gap must be small enough to assure sufficient turbulence of water flow at and between bristles as they engage the pool surface to be cleaned, and large enough to allow passage of dirt and debris.

Figure 17:
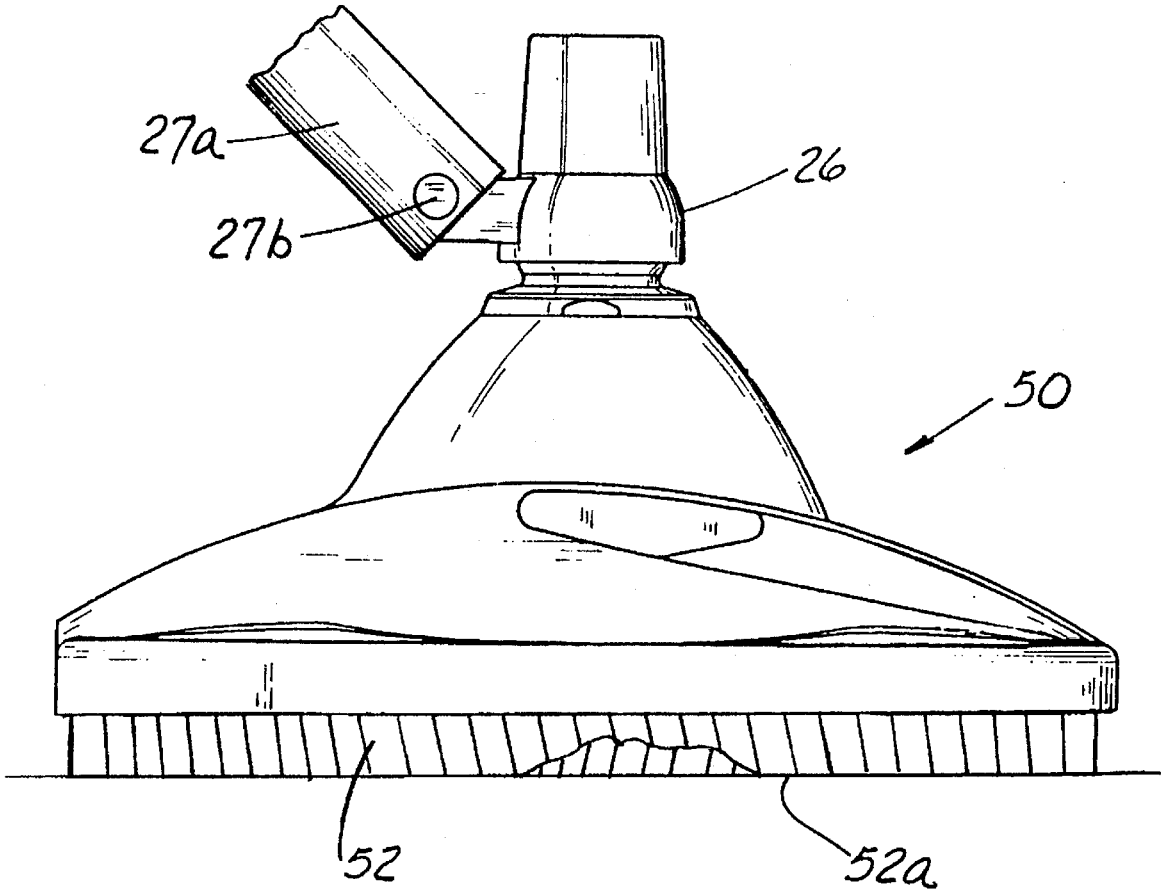
FIG. 17 is a side elevation of a preferred manual pool cleaner in accordance with this invention.

FIG. 17 illustrates a simpler suction head 50 which is designed for manual use. Suction head 50 has a single removable ring of bristles 52 about the lower edge of its housing. Unlike suction head 20, suction head 50 has no tilt adjustment feature. However, in most other respects, including the presence of vibrator 30, suction head 50 is similar to suction head 20 of the dual-use automatic pool cleaner described above.

Bristles 52 are similar to secondary bristles 42 (described above) in that they are disposed at a common rotational angle—about 12° to vertical—such that engagement of bristle ends 52*a* with underwater pool surfaces causes a turning deflection of suction head 50. Such turning, which occurs while the operator grips handle 27*a* to manipulate suction head 50, is allowed to occur by virtue of the aforementioned spherical joint 26. Furthermore, such turning is facilitated by the vibratory forces described above. The turning of suction head 50 provides enhanced scrubbing action.

Unlike secondary bristles 42, bristles 52 are not outwardly (radially) inclined; they are only rotationally inclined; that is, bristles 52 are essentially tangential to an imaginary cylinder generally at their location and each bristle is generally along a line which is a skew line with respect to the axis which is defined by the bristle ring. Outward (radial) inclination of the bristles would be acceptable, but for a manual-use pool cleaner such inclination would provide no important advantage.

In certain embodiments, the bristles of a manual cleaner in accordance witch this invention need not be inclined, either rotationally or outwardly. Vibratory action alone is sufficient to enhance the cleaning action. Furthermore, movement of the suction head along underwater surfaces tends to be facilitated by such vibratory action.

Many variations are possible in arrangement and configuration of bristles and other parts as required. The parts of this invention may be made using known materials and molding and forming methods well known to those skilled in the art. The housings, vibrators, hose connectors, tilt-adjuster, and the rings and blocks for bristle mounting are preferably made of suitable rigid plastics. The housings can be molded with all or most of their required functional elements and features integrally formed as parts or features thereof. The bristles are preferably made of common bristle materials which are flexible and resilient, and thus facilitate the moving actions described above. Sliding seals 30*d* are made of fairly rigid seal materials, one preferred material being a Dupont Delrin acetal material.

A wide variation of materials, part manufacturing methods and assembly methods can be used.

While the principles of this invention have been described in connection with specific embodiments, it should be understood clearly that these descriptions are made only by way of example and are not intended to limit the scope of the invention.

We claim:

1. An automatic swimming pool cleaner of the type driven by water flow therethrough, comprising:

a housing forming a chamber open at its lower side and having a lower edge surrounding the chamber;

a hose connection device on the housing;

a handle attachment device on the housing;

a handle detachably secured to the handle attachment device;

a vibrator device secured to the housing to vibrate the head in response to water flow through the chamber;

main bristles secured with respect to the housing and projecting downwardly to terminate in main-bristle ends for supporting the pool cleaner on a surface to be cleaned, the main bristles inclined in a first direction such that vibration causes forward movement; and secondary bristles affixed along the lower edge and protecting downwardly to terminate in secondary-bristle ends positioned for engagement with the surface to be cleaned, the secondary bristles inclined in a second direction such that, upon contact thereof with the surface to be cleaned, vibration causes a turning away from the forward direction, and the secondary bristles positioned with respect to the common plane to at least periodically engage off-planar portions of the surface to be cleaned, to allow at least intermittent turning to occur;

whereby the pool cleaner can be used manually or automatically as desired.

2. The pool cleaner of claim 1 wherein the secondary bristles project both outwardly and downwardly and are disposed at a rotational angle such that their engagement with pool side surfaces causes a turning deflection of the pool cleaner.

3. The pool cleaner of claim 1 wherein the main bristles are secured along the lower edge of the housing, the secondary bristles being positioned outside the main bristles.

4. The pool cleaner of claim 3 wherein the main bristles are secured to a main-bristle ring removably secured to the housing, and the secondary bristles are secured to a secondary-bristle ring removably secured to the housing.

5. The pool cleaner of claim 4 wherein the secondary bristles project both outwardly and downwardly and are disposed at a rotational angle such that their engagement with pool side surfaces causes a turning deflection of the pool cleaner.

6. The pool cleaner of claim 5 wherein the hose and the handle are pivotably connected to the housing.

7. The cleaning apparatus of claim 6 wherein the hose connection device is a spherical joint and the handle is attached to the spherical joint.

8. In a swimming pool cleaning apparatus of the type having a housing forming a chamber open at its lower side, a hose connection device on the housing allowing water to be drawn through the chamber, and a handle secured to the housing to allow an operator to move the apparatus along underwater surfaces to be cleaned, the improvement comprising:

a vibrator secured to the housing to vibrate the housing;

flexible bristles secured with respect to the housing at off-center positions and projecting downwardly to terminate in bristle ends for supporting the pool cleaner on a surface to be cleaned, the bristles inclined such that, when their ends engage a horizontal surface, they deviate from vertical in a substantially common rotational direction, such rotation being in a plane parallel to the horizontal surface;

whereby vibration causes rotation of the apparatus.

9. The cleaning apparatus of claim 8 wherein the vibrator is a vibrator device which vibrates the housing in response to water flow through the chamber.

10. The cleaning apparatus of claim 8 wherein housing has a lower edge surrounding the chamber and the bristles are affixed along the lower edge.

11. The cleaning apparatus of claim 10 wherein the bristles are secured to a bristle ring which is removably secured to the housing.

12. The cleaning apparatus of claim 8 wherein the hose and the handle are pivotably connected to the housing.

13. The cleaning apparatus of claim 12 wherein the hose connection device is a spherical joint and the handle is attached to the spherical joint.

14. In an apparatus for cleaning an underwater surface of a swimming pool, such apparatus being of the type having a housing forming a chamber open at its lower side, a hose connection device on the housing allowing water to be drawn through the chamber, and a handle secured to the housing, the improvement comprising:

a vibrator device secured to the housing;

an annulus of bristles secured with respect to the housing, such bristles being angled with respect to vertical and vibrated by the device to create forces urging turning motion of the apparatus on the surface;

and wherein:

the handle is mounted to the housing by plural spaced lugs, thereby permitting a user of the apparatus to resist the force and steer the apparatus on the surface.

15. The cleaning apparatus of claim 14 wherein the vibrator is a vibrator device which vibrates the housing in response to water flow through the chamber.

16. The cleaning apparatus of claim 14 wherein housing has a lower edge surrounding the chamber and the bristles are affixed along the lower edge.

17. The cleaning apparatus of claim 16 wherein the bristles are secured to a bristle ring which is removably secured to the housing.

18. The apparatus of claim 14 wherein the handle is detachably mounted, whereby the pool cleaner can be used manually or automatically.

19. In an apparatus for cleaning an underwater surface of a swimming pool, such apparatus being of the type having a housing forming a chamber open at its lower side, a hose connection device on the housing allowing water to be drawn through the chamber, and a handle secured to the housing, the improvement comprising:

a vibrator device secured to the housing;

the handle being detachably mounted to the housing, thereby permitting a user of the apparatus to steer the apparatus on the surface during manual use; and bristles secured with respect to the housing, projecting downwardly to terminate in bristle ends for supporting the apparatus on a surface to be cleaned, and vibrated by the vibrator device, such that the bristles and vibrator coact to facilitate movement of the apparatus during manual use;

whereby manual pool cleaning with an automatic pool cleaning apparatus is facilitated.

* * * * *